United States Patent [19]

Glass

[11] 4,186,952

[45] Feb. 5, 1980

[54] TURN BUTTON LATCH

[75] Inventor: Dwight W. Glass, Rockford, Ill.

[73] Assignee: Keystone Consolidated Industries, Inc., Peoria, Ill.

[21] Appl. No.: 905,881

[22] Filed: Jul. 27, 1978

[51] Int. Cl.[2] ..... E05C 3/04

[52] U.S. Cl. ..... 292/202; 292/DIG. 38; 292/DIG. 53

[58] Field of Search ..... 292/202, 209, 204, 210, 292/DIG. 38, DIG. 53; 70/355; 85/81

[56] References Cited

U.S. PATENT DOCUMENTS

| | | | |
|---|---|---|---|
| 319,887 | 6/1885 | Crump | 292/209 |
| 1,479,117 | 1/1924 | Trimmer | 292/204 X |
| 2,502,539 | 4/1950 | Tinnerman | 292/202 |
| 3,366,000 | 1/1968 | Bennett | 85/72 |
| 3,575,452 | 4/1971 | Blomgren | 292/202 |
| 3,815,182 | 6/1974 | Guard et al. | 85/81 |
| 3,877,268 | 4/1975 | Shull | 70/376 X |
| 3,986,376 | 10/1976 | Lack | 70/376 X |

*Primary Examiner*—Richard E. Moore

*Attorney, Agent, or Firm*—Allegretti, Newitt, Witcoff & McAndrews

[57] ABSTRACT

A molded plastic latch assembly includes a housing adapted to receive a rotatable latch member. The inner end of the latch member includes bifurcated locking tabs received by an opening in the bolt. The locking tabs cooperate with an integrally molded locking pin. The latch member and housing include a cooperative detent construction integrally molded in the housing and latch member.

12 Claims, 15 Drawing Figures

TURN BUTTON LATCH

BACKGROUND OF THE INVENTION

The present invention relates to an improved latch assembly and more particularly to a latch assembly of the type which may be easily manufactured from a flexible plastic material by molding techniques.

A simple, easy to assemble and inexpensive latch made from inexpensive materials has many applications, for example, in low security areas such as on cabinets, screen doors, recreational vehicle doors and the like. Typically, it is desirable that such latching mechanisms include a manual thumb latch, a bolt and be susceptible of incorporating a key operated mechanism. Additionally, a desirable feature of such a latch mechanism includes detent positioning for holding the latch in locked and unlocked positions.

Various prior art patents have considered some of these described characteristics. Included among the pertinent prior art patents are the following: Steele U.S. Pat. No. 152,774; Chase U.S. Pat. No. 385,906; Schuyler U.S. Pat. No. 966,865; Phillips U.S. Pat. No. 1,470,541; Funston et al U.S. Pat. No. 3,909,888; Shull U.S. Pat. No. 3,877,268; and Shull U.S. Pat. No. 3,951,444.

The above-identified patents while providing many desirable characteristics for a turn button latch are not believed to provide all the unique advantages and features of the following described invention.

SUMMARY OF THE INVENTION

In a principal aspect, the present invention comprises a latch assembly which includes a housing, a latch member which is rotatably inserted in the housing and a bolt which is attached to the latch member and positionable in response to rotational movement of the latch member in the housing. The housing typically fits through an opening in a door panel. The latch member may then be inserted into the housing and a bolt attached thereto to provide the finished turn button latch in operational position. As a feature of the invention, the housing and latch member include a cooperative detent structure which maintains the latch member in any one of a number of fixed positions relative to the housing. The detent mechanism utilizes the elastic characteristics of the materials used to manufacture the housing and latch member to provide detent positions. The improved latch assembly also includes a unique structure for attachment of the bolt to the latch member as well as a key operated mechanism.

It is thus an object of the invention to provide an improved latch assembly comprising a housing, a latch member and a bolt.

A further object of the present invention is to provide an improved latch assembly which may be manufactured from low cost materials, particularly plastic materials using molding techniques.

A further object of the present invention is to provide a latch member which includes integral means for cooperatively engaging and holding a bolt.

Still another object of the present invention is to provide an economically manufactured and easily installed latch assembly construction.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
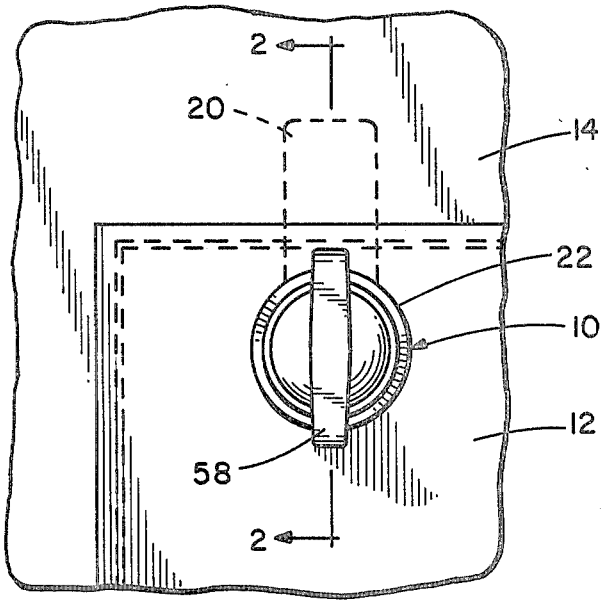
FIG. 1 is a front plan view of the improved turn button latch assembly of the present invention as installed in a cabinet door.
Figure 2:
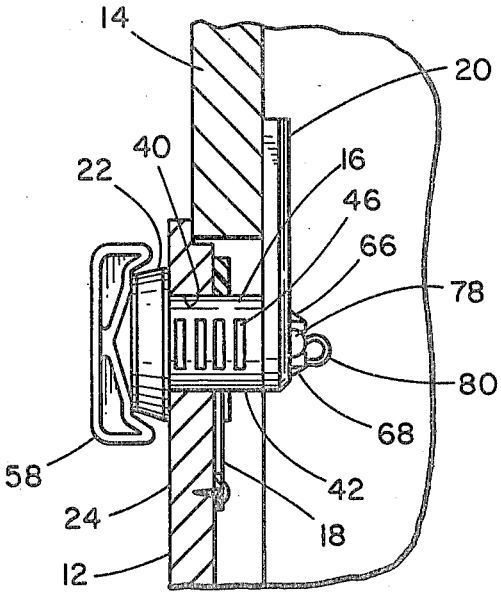
FIG. 2 is a cross-sectional view of the assembly of FIG. 1 taken along the line 2—2 in FIG. 1.
Figure 3:
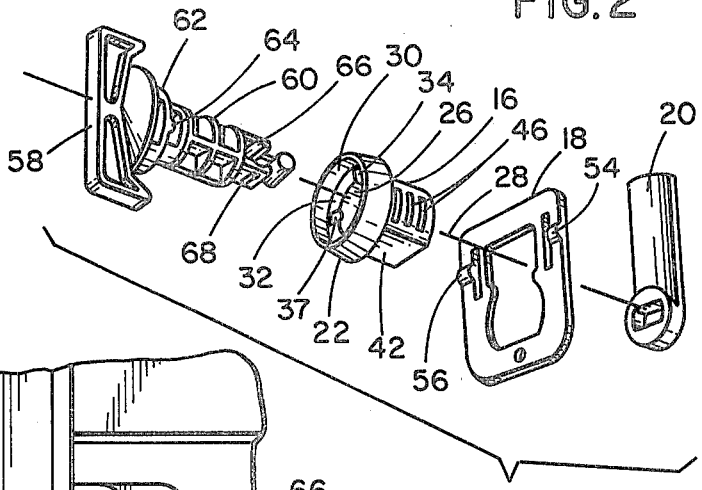
FIG. 3 is an exploded perspective view of the components forming the assembly illustrated in FIGS. 1 and 2.

FIGS. 1 and 2 illustrate the latch assembly of the present invention as attached to a cabinet door. Thus, latch assembly 10 is affixed to a cabinet door 12 associated with the cabinet frame. The assembly 10 includes a latch member 14 which cooperates with a housing 16. Housing 16, in turn, cooperates with a retainer clip 18. A bolt 20 is attached to latch member 14 and is rotated in response to movement of the thumb turn 58 of latch member 14.

Referring to all of the figures, the housing 16 which is formed from a molded plastic material includes a circumferential front plate or flange 22 that cooperates with front surface 24 of door 12. The housing 16 includes a generally cylindrical through bore 26 extending along a longitudinal axis 28. A counterbore 30 is defined in the flange 22. Counterbore 30 terminates in a front housing surface 32. Surface 32 includes spaced detent recesses 34, 35, 36 and 37 arranged at 90° intervals about the surface 32.

The housing 16 includes a rear surface 38 which cooperates with bolt 20 as will be described below.

The external shape of the housing 16 is such that the housing 16 can be keyed or immovably positioned within an opening 40 in door 12. Thus, in the embodiment shown, the housing 16 includes a flat 42.

Figure 4:
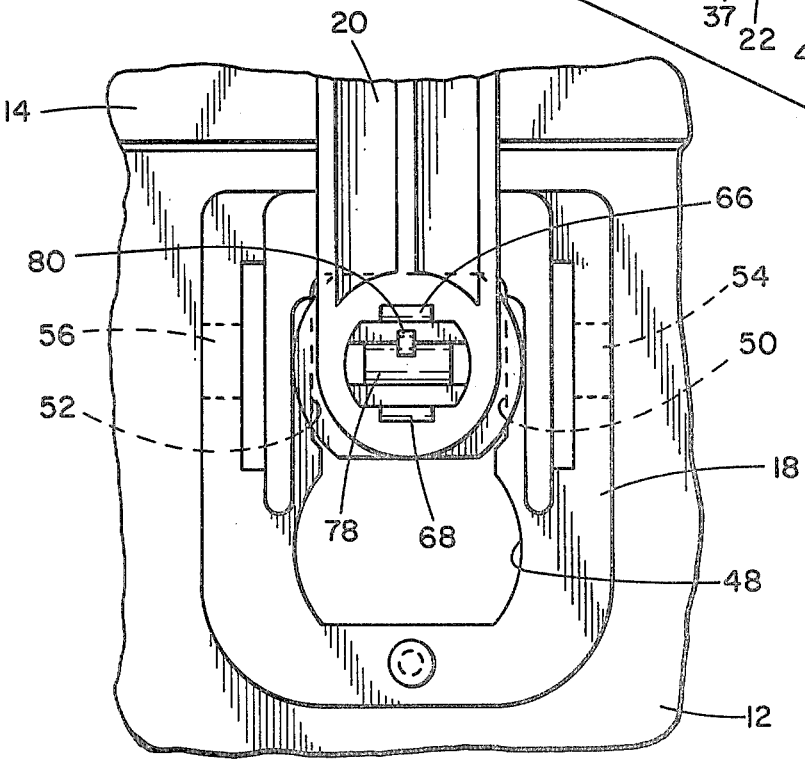
FIG. 4 is a rear elevation of the assembly shown in FIG. 1.

Opposite sides of the housing 16 include slots 46 which are cooperative with the clip 18 to retain the housing in opening 40 of door 12. Thus, clip 18 includes a keyhole shaped opening 48 as shown in FIG. 4. The full housing 16 is inserted through the lower portion of opening 48 and the retainer 18 is then slipped over the housing 16 from the end opposite flange 22. Opening 48 includes a second portion defined by sides 50 and 52 which cooperatively engages appropriate slots 46 in the side of the housing 16 when retainer 18 slides transversely to axis 28. The appropriate slots 46 which are engaged by the retainer 18 depend upon the thickness of the door.

Additionally, retainer 18 is made from a flexible material, for example, a flexible plastic material and includes biasing lugs 54 and 56 adjacent the sides 50 and 52 respectively. The lugs 54 and 56 accommodate looseness in the mounting of the housing 16 in the door 12 that may be caused by the spacing of slots 46 along the longitudinal axis 28.

The thumb turn latch member 14 includes an external thumb latch 58 which may be manually operated. Extending inwardly along the longitudinal axis 28 from the thumb latch 58 is a generally cylindrical member 60. The diameter of the cylindrical member 60 is such that it easily cooperates with through bore 26. Positioned between the thumb latch 58 and cylinder 60 is a plate 62 which cooperated with counterbore 30. Plate 62 includes an inwardly projecting rib or detent member 64 which engages opposite pairs of recesses 34–37.

The inside or opposite end of the cylinder 60 terminates with bifurcated longitudinally extending tabs or arms 66 and 68. The arms 66 and 68 terminate with end lugs 70 and 72 respectively. The bifurcated arms 66 and 68 include inside detents 74 and 76 respectively adopted to receive a locking pin 78. Locking pin 78 is integrally molded with the thumb turn latch member 14 and connected to one of the arms 68 by means of a flexible integrally molded link 80.

Figure 5:
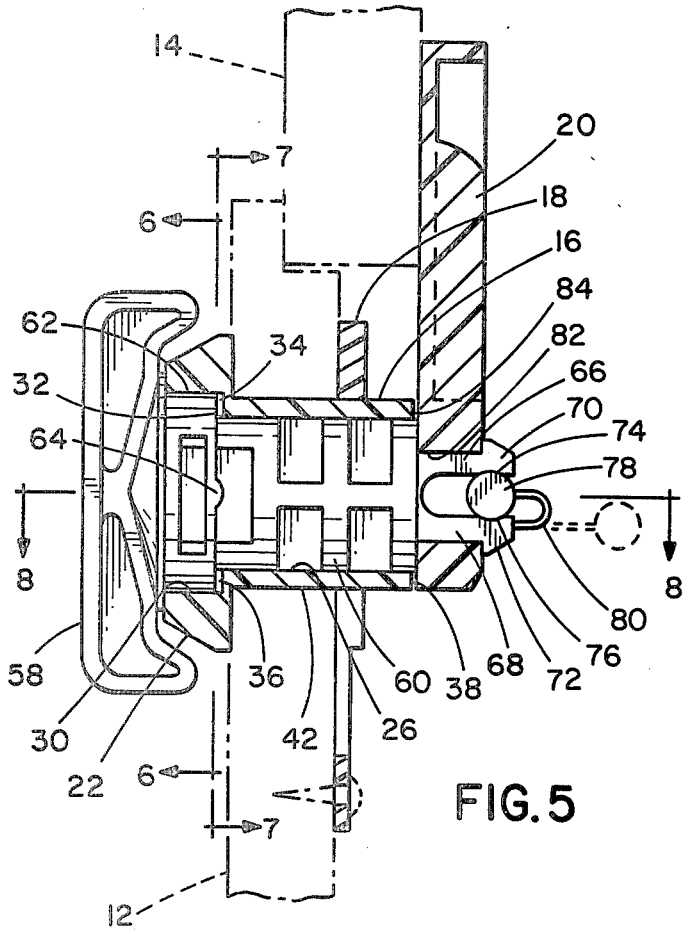
FIG. 5 is an enlarged cross-sectional view of the latch assembly similar to that shown in FIG. 2.
Figure 6:
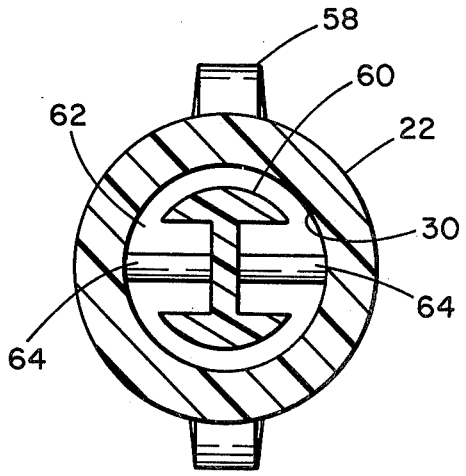
FIG. 6 is a cross-sectional view of the assembly shown in FIG. 5 taken substantially along the line 6—6.
Figure 7:
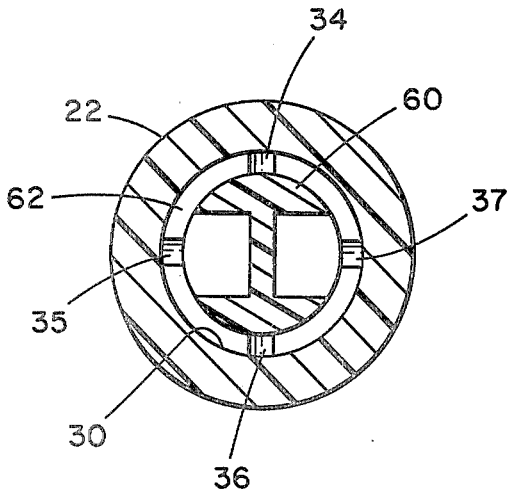
FIG. 7 is a cross-sectional view of the assembly shown in FIG. 5 taken substantially along the line 7—7.

The arms 66 and 68 fit through an opening 82 defined in the bolt 20. The arms 66 and 68 are keyed through the opening 82 so that upon rotation of the thumb latch 58, the bolt 20 will rotate therewith. Once the bifurcated arms 66 and 68 have been inserted through the opening 82 and the lugs 70 and 72 cooperatively engaged with the opposite sides of the opening, pin 78 is inserted into recesses 74 and 76 in the manner shown in FIG. 5. This prevents removal or slipping of the bolt 20 from the arms 66 and 68.

The bolt 20 includes a generally flat bearing surface 84 which cooperates with the end surface or rear surface of housing 16.

Figure 8:
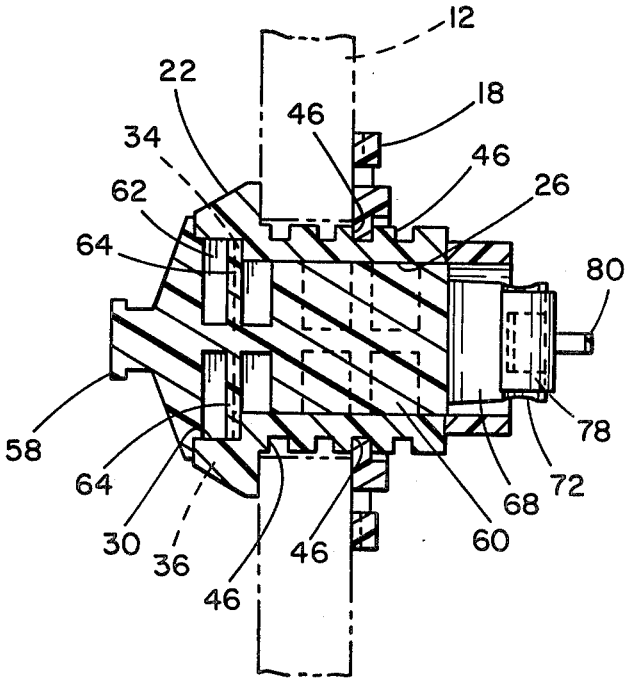
FIG. 8 is a cross-sectional view of the assembly taken substantially along the line 8—8 in FIG. 5.
Figure 9:
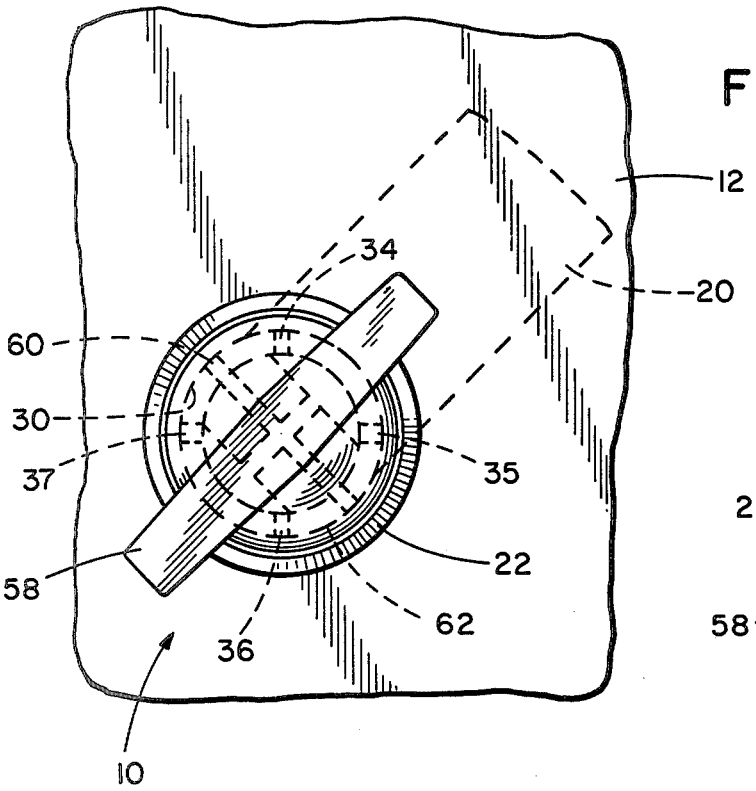
FIG. 9 is a front elevation of the turn button latch of the invention wherein the latch has been positioned in the non-detent position.

The assembly, particularly the housing 16 and/or the thumb turn latch member 14, are preferably molded from an elastic material. The elastic material permits movement of the thumb turn latch member 14 from the detent position as illustrated in FIG. 8 to a non-detent position as illustrated in FIG. 9. Another reason for molding the thumb turn latch member 14 from an elastic material is that the pin 78 may be integrally molded therewith. Moreover, the pin 78 as connected by the flexible link 80 may then be positioned as necessary between the bifurcated arms 66 and 68. Consequently, the total thumb turn latch member which has a multiplicity of functions during assembly of the entire latch does not require a multiplicity of separate parts.

Figure 11:
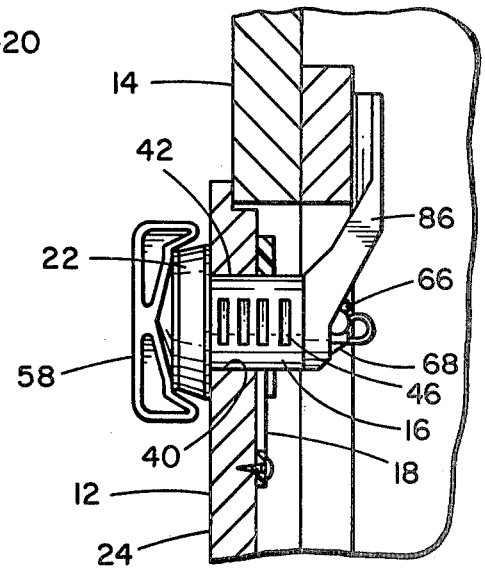
FIG. 11 is a side cross-sectional view similar to FIG. 2 wherein a second embodiment of a bolt has been substituted.
Figure 10:
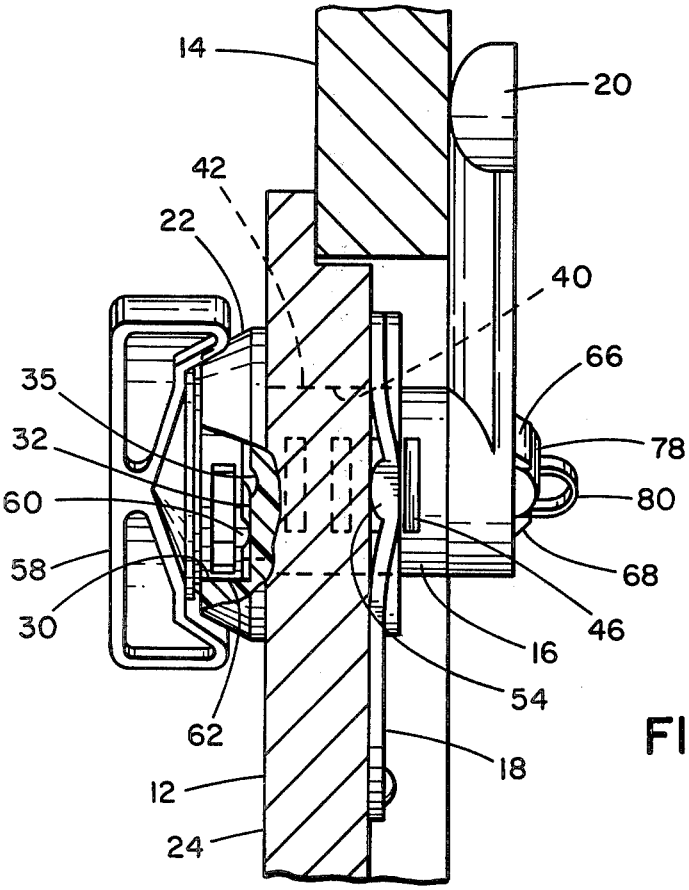
FIG. 10 is a partial side cross-sectional view of the assembly of FIG. 9.

It is possible to substitute various bolts 20. For example, as shown in FIG. 11, an articulated bolt 86 may be substituted in place of the straight bolt 20 shown in the previous figures. With the latch assembly of the present invention, it is possible to easily assemble and/or replace the various components forming the latch.

Additionally, it is possible to substitute a key operated thumb turn latch member for the manually operated thumb turn latch member 14. FIGS. 12–15 illustrate this substitution and construction.

Figure 12:
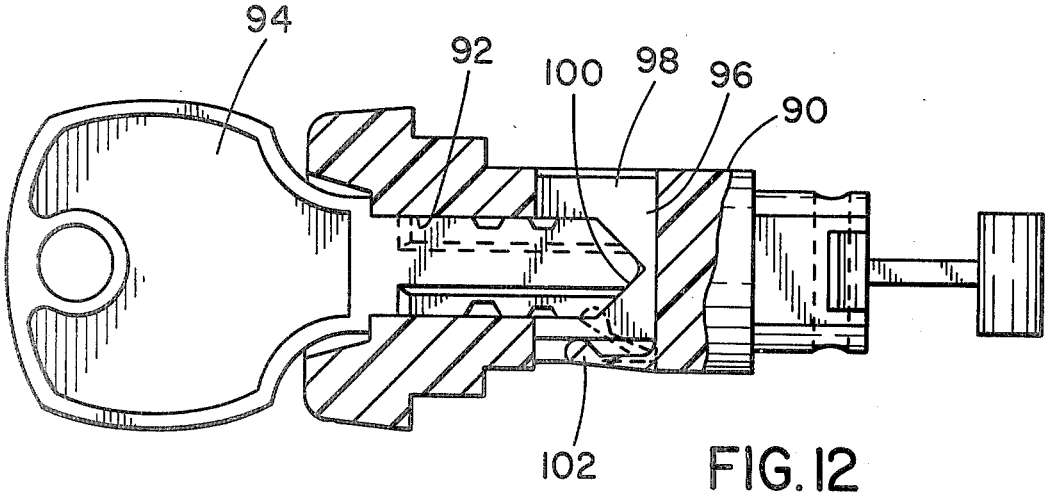
FIG. 12 is a partial cross-sectional side elevation of an alternative embodiment utilizing a key actuator.
Figure 13:
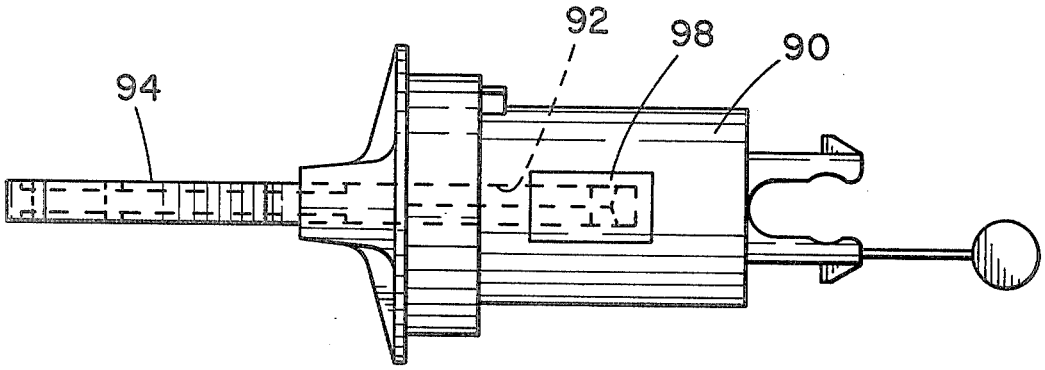
FIG. 13 is a top plan view of the embodiment of FIG. 12.
Figure 14:
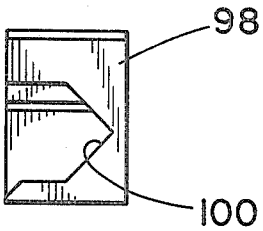
FIG. 14 is a side plan view of the tumbler for the embodiment of FIG. 12.

Referring to FIGS. 12–15, a cylinder 90 includes a key slot 92 for receipt of the key 94. A transverse slot 96 receives a tumbler 98. The structure of the tumbler 98 is illustrated in more detail in FIG. 14. The tumbler 98 includes a key slot 100 for receipt of the active end of key 94. The tumbler 100 is inserted in the slot 96 as shown in FIGS. 12 and 13. An integrally molded biasing arm 102 which is cantilevered from bottom edge of slot 96 of cylinder 90, engages the underside of tumbler 98 when the key 94 is removed. This causes the tumbler 98 to project upwardly to the phantom position shown in FIG. 12. When in the phantom position shown in FIG. 12, the tumbler 98 engages a housing (not shown). This prevents rotation of the cylinder 90.

Figure 15:
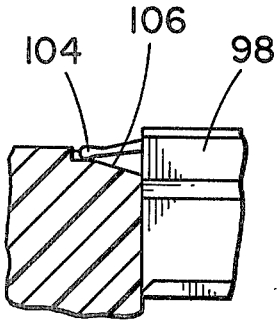
FIG. 15 is a side plan view of an alternative tumbler construction for the embodiment of FIG. 12.

FIG. 15 illustrates an alternative tumbler design wherein the integral biasing arm 104 extends from tumbler 98 and engages an active surface 106 associated with the cylinder 90. Both of the tumbler shown in FIGS. 14 and 15, however, are normally biased by means of the integrally molded biasing arm 102, 104 toward a position of engagement with an appropriate slot in the housing that receives the cylinder 90.

Thus, while there has been set forth a preferred embodiment of the invention, it is to be understood that the invention shall be limited only by the following claims and their equivalents.

What is claimed is:

1. A latch assembly comprising, in combination:

a housing having a longitudinal axis, a cylindrical through bore along the axis, a front face, a back face, and a counterbore in the front face;

a latch member including a cylinder projecting through the through bore, a knob on one end of the cylinder for manual rotation of the latch member, a counterbore flange in opposed, cooperative relation with the front face counterbore of the housing, and bolt attachment means on the other end of the cylinder;

a bolt cooperatively engaging the bolt attachment means and rotatable in response to manual rotation of the knob, one of said counterbore flange and said counterbore including at least two recesses and the other of said counterbore flange and said counterbore including at least one projection for cooperation with said recess to maintain the latch member in a fixed position relative to the housing, said latch member being elastic along the longitudinal axis to permit flexure of the latch member and removal of the projection from the recess upon rotation of the latch member about the axis.

2. The assembly of claim 1 wherein the bolt attachment means comprise bifurcated arms extending from the cylinder along the longitudinal axis for projecting through an opening defined in the bolt.

3. The improved assembly of claim 2 wherein said bifurcated arms are elastic and are retained in spaced relationship with each other and in frictional engagement with the bolt by means of a spacing pin inserted between the bifurcated arms.

4. The improved claim assembly of claim 1 wherein said spacing pin is integrally molded with and attached to at least one of the bifurcated arms.

5. The assembly of claim 1 including means for cooperation with said housing to retain said housing in position in an opening defined in a door.

6. The assembly of claim 5 wherein said means for retaining comprises a flange at one end of said housing and a separable plate member engageable with slots defined in the opposite end of the housing whereby said housing may be inserted into an opening defined through a door with the flange engaging one side of the door and the plate engaging the opposite side of the door.

7. The assembly of claim 6 wherein said plate comprises a flexible plate cooperative with any one of a series of slots defined in the housing, the plate being flexible to accommodate varying door thicknesses.

8. The assembly of claim 6 wherein said plate comprises a flexible plate with tab members projecting toward the flange.

9. A latch assembly comprising in combination:

a housing having a longitudinal axis, a cylindrical through bore along the axis, a front face, and a back face;

a latch member including a cylinder projecting through the through bore, a knob on one end of the cylinder for manual rotation of the latch member, and bolt attachment means on the other end of the cylinder;

a bolt cooperatively engaging the bolt attachment means and rotatable in response to manual rotation of the knob, said bolt including an opening for receipt of the bolt attachment means, said bolt attachment means comprising bifurcated spaced arms cooperative with the opening in said bolt and means for spreading said arms to tightly engage the sides of the opening in said bolt, said means for spreading including a pin member sized for positioning between the arms and integrally formed with one of the arms, said pin member being positioned between the bifurcated arms to retain the bolt on the latch member.

10. A latch assembly comprising, in combination:

a housing having a longitudinal axis, a cylindrical through bore along the axis, a front face, and a back face;

a latch member including a cylinder projecting through the through bore, a key slot in the cylinder, a movable tumbler mounted in the key slot in the latch member, one of said tumbler and said cylinder including an integrally molded spring member engaging the other of cylinder and tumbler to project the tumbler into cooperative locking engagement with the housing, said tumbler including a key receiving slot which receives a key to translate the tumbler out of engagement with the housing, and bolt attachment means at the end of the cylinder opposite the end which receives a key; and a bolt cooperatively engaging the bolt attachment means at one end of the cylinder.

11. The assembly of claim 10 wherein said integral spring member is on the tumbler.

12. The assembly of claim 10 wherein said integral spring member is on the cylinder and engages the tumbler.

* * * * *